US006085955A

United States Patent [19]

Hicks et al.

[11] Patent Number: 6,085,955

[45] Date of Patent: Jul. 11, 2000

[54] WRIST MOUNTABLE TAPE DISPENSER

[76] Inventors: Gary Hicks, P.O. Box 180447, Utica, Mich. 48318; Robert Moriarty, 7428 Orene, Utica, Mich. 48317

[21] Appl. No.: 09/079,746

[22] Filed: May 15, 1998

Related U.S. Application Data

[60] Provisional application No. 60/047,202, May 20, 1997.

[51] Int. Cl.[7] ..... B65H 75/40

[52] U.S. Cl. ..... 225/78; 225/42; 225/47

[58] Field of Search ..... 30/298, 232, 275.4, 30/291; 225/56, 57, 14, 47, 25, 66, 78, 36, 38, 52, 53, 58, 65, 96.5, 106

[56] References Cited

U.S. PATENT DOCUMENTS

| | | | |
|---|---|---|---|
| 739,390 | 9/1903 | Coad et al. | 30/298 |
| 925,529 | 6/1909 | Thomas | 30/298 |
| 1,892,544 | 12/1932 | Wanders . | |
| 2,640,656 | 6/1953 | Donkin | 225/25 |
| 2,929,540 | 3/1960 | Carey | 225/14 |
| 2,963,208 | 12/1960 | Yates et al. | 225/78 |
| 3,170,613 | 2/1965 | Casey | 225/66 |
| 3,217,955 | 11/1965 | Tinkey | 225/47 |
| 3,567,557 | 3/1971 | Kingery et al. | 156/523 |
| 3,969,180 | 7/1976 | Ravesloot | 156/523 |
| 3,980,245 | 9/1976 | Delehoy | 225/78 |
| 3,993,230 | 11/1976 | Oakes | 225/47 |
| 4,059,210 | 11/1977 | Deering, Jr. | 225/47 |
| 4,088,276 | 5/1978 | Littleton | 225/53 |
| 4,157,616 | 6/1979 | Lundqvist | 30/298 |
| 4,880,152 | 11/1989 | Trankle | 225/78 |
| 4,915,768 | 4/1990 | Soderberg | 156/527 |
| 5,065,925 | 11/1991 | Ridenour | 225/78 |
| 5,215,236 | 6/1993 | Waddell | 225/78 |
| 5,468,332 | 11/1995 | Dretzka et al. | 156/527 |

*Primary Examiner*—Rinaldi I. Rada
*Assistant Examiner*—Kim Ngoc Tran
*Attorney, Agent, or Firm*—Gifford, Krass, Groh, Sprinkle, Anderson & Citkowski, P.C.

[57] ABSTRACT

A wrist mountable tape dispenser includes a tape holder which supports a roll of tape for rotation and dispensing. An adjustable wrist connector connects the tape holder to the wrist. The tape holder also supports a cutter for cutting the tape dispensed from the dispenser.

6 Claims, 2 Drawing Sheets

WRIST MOUNTABLE TAPE DISPENSER

RELATED APPLICATIONS

This application claims priority of Provisional patent application Ser. No. 60/047,202 filed May 20, 1997, entitled "Wrist Held Tape Dispenser."

TECHNICAL FIELD

The present invention relates generally to manually operated tape dispensers including a tape cutter and more specifically to a tape dispenser configured to be mounted on a wrist.

BACKGROUND OF THE INVENTION

Tape dispensers are generally known in the art but there has been continuing effort to create tape dispensers which are easy to use, convenient and inexpensive. Convenience and ease of use of a tape dispenser can be enhanced by locating the tape dispenser within easy reach of a work space. Convenience is also enhanced if tape can be dispensed from the tape dispenser using only one hand. This allows a person using a tape dispenser to dispense tape without having to remove both hands and/or their eyes from a work piece.

Many tape dispensers currently on the market require two hands to operate. This forces a user to remove both hands from a work piece each time a piece of tape is desired. Other attempts to address the need for one handed dispensing of tape include tape dispensers with heavy bases and hand held tape dispensers. A tape dispenser with a heavy base allows tape to be pulled from the dispenser with one hand without moving the base. However, a tape dispenser with a heavy base must be picked up and moved as the user moves from work space to work space. Otherwise the tape dispenser does not remain within easy and convenient reach.

Some hand held tape dispensers allow one handed use. U.S. patents disclosing hand-held tape dispensers include: U.S. Pat. No. 1,892,544 to Wanders; U.S. Pat. No. 3,170,613 to Casey; U.S. Pat. No. 3,567,557 to Kingery et al; U.S. Pat. No. 3,969,180 to Revesloot; U.S. Pat. No. 4,915,768 to Soderberg; and U.S. Pat. No. 5,468,332 to Dretzka et al. These dispensers are positioned against a work piece thereby bringing a portion of the tape into contact with the work piece. Then the tape dispenser is moved across the work piece and tape is dispensed. Hand-held tape dispensers are particularly useful for dispensing wide tape onto boxes to be shipped but are less suitable for other types of work. They are especially difficult to use with small work pieces or where a very small piece of tape is required. Hand-held tape dispensers typically exert significant forces on a work piece in order to dispense tape. As the dispenser is moved across a work piece, the adhesive tape typically resists being unrolled, therefore significant force is exerted by the tape already adhered to the work piece. This is especially undesirable when wrapping gifts, as exertion of force on wrapping paper will either tear the paper or cause it to wrinkle in an unattractive manner. Hand-held tape dispensers must also be moved from work space to work space to remain within convenient reach. Also, a hand held tape dispenser requires the person to pick up the tape dispenser, use the tape dispenser to dispense tape, and replace the tape holder within convenient reach each time a piece of tape is desired. This type of tape dispenser can be inconvenient where the user repeatedly needs to dispense pieces of tape and thus must repeatedly pick up and put down the tape dispenser.

Therefore, there is a need for a tape dispenser which remains within easy and convenient reach of a user as the user moves from work space to work space. There is also a need for a tape dispenser which eliminates the need to pick up and put down the tape dispenser.

Several United States patents are directed to tape dispensers designed to be clipped or otherwise attached to an article of clothing so that the tape dispenser remains with the user even if the user moves from place to place. U.S. Pat. No. 2,929,540 to Carey is directed to a tape dispenser designed to dispense a spool of tape and having a resilient clip on the backside of the dispenser so that the dispenser can be clipped to a belt. This invention is particularly designed for workers such as members of survey crews who periodically require tape and wish to have it near at hand. U.S. Pat. No. 3,217,955 to Tinkey is directed to a tape dispenser having a pair of slots in its backside so that a belt may be fed through the slots and the belt and dispenser can be worn around a person's waist. U.S. Pat. No. 5,065,925 to Ridenour discloses a tape dispenser which has a pair of clips allowing it to be clipped to an article of clothing such as a belt. Tape dispensers such as these which can be clipped to an article of clothing overcome some of the shortcomings of traditional tape dispensers. By having the tape dispenser attached to an article of clothing, the user has a tape dispenser with them as they move from place to place. By having the dispenser attached to part of their body, tape can be dispensed with only one hand since the dispenser is held stationary. This avoids necessity of repeatedly picking up the tape dispenser to use it. However, these designs still fall short of meeting the needs of some users. Positioning the tape dispenser on an article of clothing, especially near the waist of the user, places the tape dispenser in an inconvenient position for some tasks. For example, a user who is working with small items or wrapping gifts may not wish to reach as far as their waist. Also, if a person is working at a table of desk, it would be necessary for them to redirect their attention to an area where the dispenser is located in order to grip and dispense tape with one of their hands. This requires diverting their attention from a work piece long enough to locate, grip, dispense, and tear off a piece of tape. Also, if a person is sitting down, especially at a table or other work surface, their belt could be difficult to reach. This is especially true since the belt-mounted tape dispensers are designed primarily to be operated by a hand on the opposite side of the body. If the tape dispenser is mounted on the left side of the body, the user must reach across their body with their right hand to grip and dispense tape. This is both inconvenient and uncomfortable. Therefore, there is a need for a tape dispenser which stays with the person as they move from place to place but also is conveniently located so that the person does not have to redirect their attention or reach across their body to access the tape.

There have been some attempts to locate tape dispensers on a user's hands. For example, U.S. Pat. No. 3,993,230 to Oakes discloses a tape dispenser having finger gripping openings so that the tape dispenser can be worn on one or more fingers like a large piece of jewelry. Though evidently not patented, there is also a marketed tape dispenser which includes a non-adjustable band designed to extend across the palm of the user's hand, below the thumb, so that the tape dispenser is mounted on the back of the person's hand. These approaches locate the dispenser more conveniently, but still have several shortcomings. Both devices interfere with movement and use of the hand on which they are mounted. To use the devices, tape is dispensed from the dispenser using the hand on which the dispenser is not mounted. Dispensing the tape exerts a force against the hand and fingers on which the dispenser is mounted, thereby making it more difficult for the user to hold that hand still. This is problem especially where the hand on which the dispenser is mounted is being used to hold a work piece stationary in preparation for a piece of tape. Positioning a tape dispenser on a hand or fingers also may be uncomfortable for many users. Especially with the finger-mounted invention of Oakes, the mounting arrangements tend to interfere with the natural motion of the hand and the fingers. The hand-mounted device has a band which is not adjustable and therefore will not properly fit many people's hands. It also cannot be worn on a wrist since the mounted strap is designed to be worn only on the hand below the thumb.

SUMMARY OF THE INVENTION

There is disclosed herein a wrist mountable tape dispenser which includes a tape holder configured for supporting a roll of tape for rotation and dispensing. The dispenser includes an adjustable wrist connection means for connecting the tape holder to the wrist, and a cutter supported on the tape holder for cutting the tape dispensed from the dispenser. In some embodiments, the tape holder includes a base portion and a pair of upwardly extending tape retaining arms for supporting the roll of tape. In other embodiments, the base portion includes a first and second attachment portion and the adjustable connection means is a strap which extends from the first attachment portion to the second attachment portion.

DETAILED DESCRIPTION OF THE PREFERRED EMBODIMENT

Figure 1:
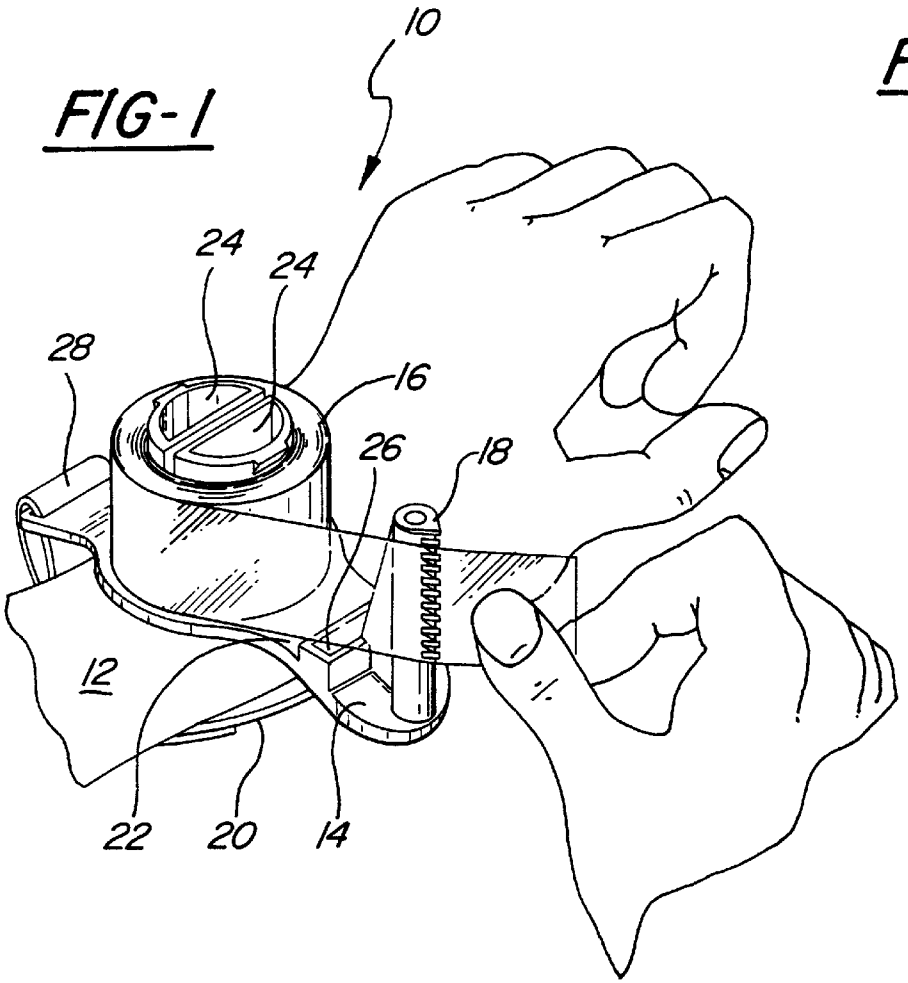
FIG. 1 is a perspective view of a tape dispenser according to the present invention mounted on a wrist with a roll of tape installed on the tape holder.

Referring now to FIG. 1, a tape dispenser 10 is shown mounted on a wrist 12. The tape dispenser 10 includes a tape holder 14 which supports a roll of tape 16 for rotation and dispensing. A cutter 18 is supported on the tape holder 14 and is positioned so that tape from roll 16 passes adjacent the cutter 18 as the tape is being dispensed. A strap 20 attaches the holder 14 to the wrist 12.

The wrist mounted tape dispenser 10 of the present invention offers several advantages over the prior art. By being mounted securely to a wrist 12, tape can be dispensed from the tape dispenser 10 using only one hand. The tape dispenser is also positioned very close to a work piece and within easy reach, so a user does not need to redirect their attention to dispense tape. It does not require the user to pick the tape dispenser up for use or to carry it to a new work space. The positioning of the tape dispenser 10 minimizes wasted motion.

Wrist mounting the dispenser 10 keeps it out of the way allowing natural movement of the hand and fingers. Most users are comfortable mounting something to their wrist, much like a watch. The strap 20 is adjustable, allowing the dispenser 10 to fit all users and to assure a secure fit.

The holder 14 includes a base portion 22 which is shaped so as to fit on the wrist 12. Two tape roll retaining arms 24 extend upwardly from the base portion 22 and are designed to hold the roll of tape 16. As shown, the tape roll 16 lays on its side so that the axis of rotation is perpendicular to the base portion 22. The base portion also includes a first strap attachment portion 26 and a second strap attachment portion 28 which are positioned apart from one another and on opposite sides of the tape roll retaining arms 24. The first attachment portion 26 preferably affixes an end of the strap 20 to the holder 14 and the second attachment portion preferably is a slot large enough for the strap 20 to pass through. The strap 20 attaches to the first attachment portion 26, passes around the wrist 12, and attaches to the second attachment portion 28. Preferably, the strap 20 includes separable hook and loop fastener material to allow one portion of the strap 20 to be secured to another portion of the strap 20. The preferred strap 20, including separable hook and loop fastener material, attaches to the first attachment portion 26, passes around the wrist 12, passes through second attachment portion 28, and then returns back and fastens to itself below the wrist 12. The separable hook and loop fastener material allows the strap to adjust to different size wrists. The strap 20 has sufficient length for securing the holder 14 to the wrist 12, preferably in the range of three to twelve inches.

Figure 2:
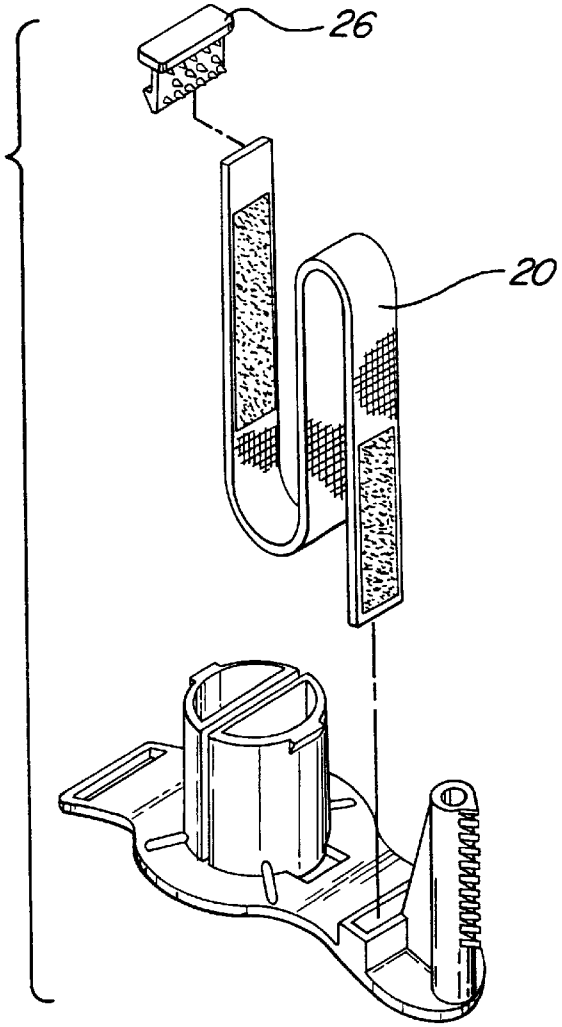
FIG. 2 is an exploded view of the tape dispenser of FIG. 1 showing the construction thereof.
Figure 3:
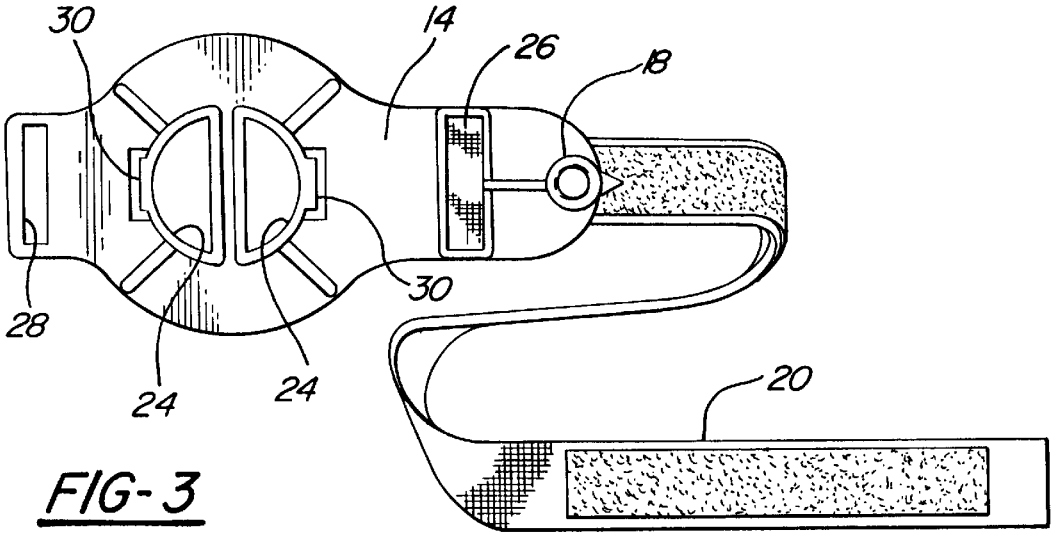
FIG. 3 is a plan view of the tape dispenser of FIG. 1.
Figure 4:
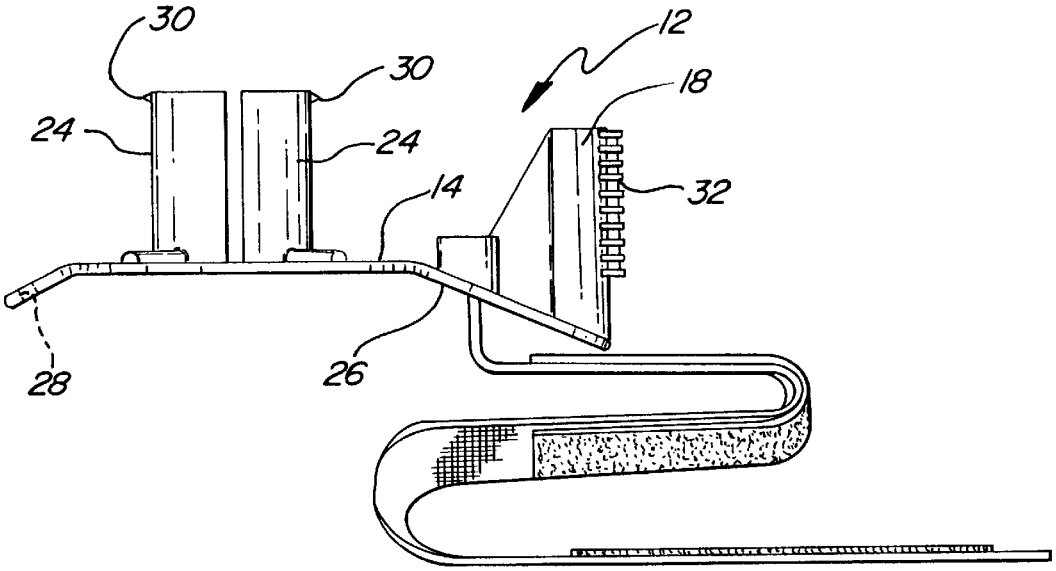
FIG. 4 is a elevational view of the side of the tape dispenser of FIG. 1.

Referring now to FIGS. 2–4, details of the tape holder 14 and cutter 18 can be more easily seen. Each upwardly extending tape roll retaining arm 24 has a half circle cross-section when viewed from above and includes a retaining tab 30 for retaining the tape roll 16 on the arms 24. The holder 14 is preferably molded from a resilient material such as plastic. This allows the arms 24 to flex as a roll of tape 16 is pressed over retaining tabs 30. The tape holder 14 also includes four ridges 42 on the base portion 22 which radiate outwardly from the arms 24 and serve to support the side of the tape roll 16 and prevent if from sticking to the base portion 22.

The tape dispenser 10 can be worn on either a left or right wrist. In FIG. 1, the tape dispenser 10 is shown mounted on the left wrist 12 with the cutter 18 facing the right wrist. In this position, tape from the roll 16 can be easily gripped by fingers of the right hand. To use the tape dispenser 10 on the right wrist with the cutter 18 facing the left wrist, the tape roll 16 can be flipped so that the tape passes on the other side of the cutter 18.

The cutter 18 extends upwardly from and perpendicular to the base portion 22 and preferably includes a reinforcing brace 44 that strengthens the cutter 18. As shown, the cutter 18 is parallel to and spaced from the tape retaining arms 24. The cutter 18 also includes cutting teeth 32 for severing tape as it is pulled against the cutter 18.

Details of the first attachment portion 26 can be seen most easily in FIG. 2. The first attachment portion 26 is made up of a recess 34 in the base portion 14 and an insert 36 configured to engage the recess 34. The recess 34 is large enough to accept the end of the strap 20. The insert 36 has a plurality of sharp teeth 38 extending therefrom which engage the end of the strap 20. The insert 36 also has a projection 40 which extends from the side of the insert 36 opposite the teeth 38. To assemble the strap 20 and the holder 14, the end of the strap 20 is fed through the recess 34 and is placed in contact with the teeth 38 of the insert 36. The insert 36 along with the strap end are then inserted into the recess 34 and pressed down until the projection 40 engages a corresponding notch (not shown) in the recess 34. The end of the strap 20 is now locked in the recess 34.

As will be clear to one of skill in the art, the preferred embodiment of the tape dispenser 10 can be altered in various ways without departing from the spirit of the invention. For example, instead of a strap 20 connecting the holder 14 to the wrist 12, the dispenser 10 may include a pair of flexible plastic bracelet halves which serve to grip the wrist 12. The strap 20 may alternatively include a D-ring at one of its ends so that the strap 20 passes around the wrist, through the D-ring, and then returns back and attaches to itself. The strap 20 may also be made of elastic material or be a two-piece watch band with a buckle or clasp. The cutter 18 may include a metal insert that defines cutting teeth 32 for applications requiring sharper cutting teeth 32. The present invention can also be used with other rolled goods requiring convenient one handed dispensing. This may include ribbon, string, correction tape, as well as all types of adhesive tape.

In view of the teaching presented herein, other modifications and variations of the present inventions will be readily apparent to those of skill in the art. The foregoing drawings, discussion, and description are illustrative of some embodiments of the present invention; but are not meant to be limitations on the practice thereof. It is the following claims, including all equivalents, which define the scope of the invention.

We claim:

1. A wrist mountable tape dispenser comprising:

a tape holder configured for supporting a roll of tape for rotation and dispensing, said tape holder further including a base portion having a first attachment portion and a second attachment portion, said first attachment portion comprising a recess defined in said base portion and a strap retaining insert, said recess being configured to accept an end of a strap and said strap retaining insert being configured to engage said end of said strap so that said end of said strap is fixed in said recess;

a strap for connecting said tape holder to the wrist, said strap having a first end which is disposed in the recess of the first attachment portion and engaged by said strap retaining insert, said strap extending from said first engagement portion and being engageable with said second attachment portion so as to connect said holder to the wrist; and a cutter supported on said tape holder for cutting the tape.

2. The tape dispenser according to claim 1, wherein said recess has a notch defined therein and said insert has a projection extending therefrom for engaging said notch when said insert engages said recess thereby locking said insert in said recess.

3. The tape dispenser according to claim 1, wherein said insert comprises a plurality of pointed teeth for engaging said end of said strap.

4. The tape dispenser according to claim 1, wherein said second attachment portion comprises a slot defined through said base portion, said slot configured to accept said strap.

5. The tape dispenser according to claim 1, wherein said strap comprises an elongated flexible strap having separable hook and loop fastener material disposed thereon so that said strap can attach to itself.

6. A wrist mountable tape dispenser for supporting and dispensing a roll of tape of the type having a central spool with a cylindrical central bore and a cylindrical tape supporting surface, the tape disposed on the tape supporting surface, said dispenser comprising:

a tape holder configured for supporting the roll of tape for rotation and dispensing, said holder having a base portion with a pair of upwardly extending tape retaining arms, said arms each having a lower end supported on said base portion and an upper end, each of said arms further having an arcuate, outwardly facing surface for supporting the central bore of the tape roll spool, each of said arms having a retaining tab extending outwardly from said outwardly facing surface adjacent said upper end for retaining the spool on said arms, said base portion further having a first and a second strap attachment portion, said holder further configured to fit the wrist;

an elongated flexible strap having separable hook and loop fastener material disposed thereon so that said strap can attach to itself, said strap being configured to attach said holder to the wrist, said strap having a length sufficient to extend around at least a portion of the wrist;

said first attachment portion comprising a recess defined in said base portion of said holder and a strap retaining insert, said recess configured to accept an end of said strap and having a notch defined therein, said insert configured to engage said end of said strap and said recess so that said end of said strap is affixed in said recess, said insert having a plurality of pointed teeth for engaging said end of said strap and a projection for engaging said notch;

said second attachment portion comprising a slot defined through said base portion, said slot configured to accept said strap; and a cutter supported on said tape holder for cutting the tape, said cutter extending upwardly from said base portion of said holder and spaced from said arms, said cutter having cutting teeth disposed thereon.

* * * * *